US006631850B1

(12) United States Patent
Wa

(10) Patent No.: US 6,631,850 B1
(45) Date of Patent: Oct. 14, 2003

(54) FLEXIBLE TRACK FOR A TOY VEHICLE

(75) Inventor: Choi Man Wa, Fanling (HK)

(73) Assignee: Battat Incorporated, Plattsburgh, NY (US)

( * ) Notice: Subject to any disclaimer, the term of this patent is extended or adjusted under 35 U.S.C. 154(b) by 0 days.

(21) Appl. No.: 10/266,526

(22) Filed: Oct. 8, 2002

(51) Int. Cl.[7] ..... A63H 18/12

(52) U.S. Cl. ..... 238/10 F; 238/10 R; 403/52; 104/60

(58) Field of Search ..... 238/10 R, 10 A, 238/10 E, 10 F; 403/52, 53, 56, 59, 61; 446/444, 448; 104/60, 53

*Primary Examiner*—S. Joseph Morano
*Assistant Examiner*—Frantz F. Jules
(74) *Attorney, Agent, or Firm*—Levisohn, Lerner, Berger & Langsam LLP

(57) ABSTRACT

A track for a toy vehicle is provided. The inventive track includes at least one end segment, either male or female, and at least one middle segment. The middle segment is pivotably attachable to at least one of the male and female segments. A middle segment can have teeth on both ends, tooth-receiving cavities on both ends, or a set of teeth on one end and a cavity on the other. The teeth of one segment are selectively engageable with the edges of a cavity of an adjacent segment. When teeth engage a cavity, one segment is fixedly angled with respect to the other segment. By repeating this pivotably angled structure between a number of segments, the curvature of the track can be altered to the taste and specifications of the user.

16 Claims, 6 Drawing Sheets

FLEXIBLE TRACK FOR A TOY VEHICLE

BACKGROUND OF THE INVENTION

1. Field of the Invention

The present invention relates to a flexible toy track. More specifically, the present invention relates to a flexible track for a toy vehicle having interlinking components, providing an angle to each track segment with respect to its adjacent track segments so as to curve the track and having teeth mating with edges for selectively maintaining the track in a curved configuration.

2. Description of Related Art

For many years, toy trains have been popular, especially among children. Frequently, toy trains are constructed to run along a toy train track. A number of different types of children's toy train tracks have been suggested in the past. These train tracks typically have sections of wood, plastic or metal which are straight or curved and which can be interconnected by the child to form a circuitous toy train track along which a toy train can be rolled without interruption on the track. In one conventional arrangement, a first track section having a tongue at one end is connected by mating the tongue to a receiving slot or groove in a second track section, and this arrangement repeats for the length of the train track. This arrangement generally does not allow for significant flexibility in the construction of a closed loop train track. One problem arises in that the standard curved track has a fixed radius of curvature; it is difficult to create an interesting and closed loop when one has a finite number of choices of curved sections from which to choose. Other structures for interconnecting train tracks that have been used in the past have generally been found to be overly complicated or do not provide a mechanism for locking the train track segments in a selected position of curvature. There is a need for a toy train track that is simple in construction and allows for flexibility in the connection between adjoining train track sections so as to allow the user playing with the track to arrange it in different curvatures as desired while maintaining continuity of the track sections.

SUMMARY OF THE INVENTION

An object of the present invention is to provide a track for a toy vehicle that allows for flexibility in the curvature and connection between adjoining train tracks.

Another object of the present invention is to provide a track for a toy vehicle that may be manipulated by the child to form different curvatures.

Another object of the present invention is to provide a simple mechanism for maintaining a track segment in a curved position relative to adjacent track segments, while maintaining contiguity of the track sections so that a train can pass thereover without derailment.

The above and other objects are fulfilled by the invention, which is a track for a toy vehicle. The inventive track, capable of being curved into a wide variety of curves, includes at least one end segment, and at least one middle segment.

The end segment is at least one of i) a male segment having a tongue projecting from one of a first end and a second opposite end and having teeth protruding from the other of the first and second opposite ends; and ii) a female segment having an aperture to receive the tongue and a first cavity to receive the teeth of either a male segment or a middle segment. The middle segment is attachable to the male segment and/or the female segment and pivotably attaches to at least one of the male and female segments.

The middle segment has any one of the following configurations: i) a second cavity and a second set of protruding teeth disposed on opposite ends of the middle segment; ii) a second cavity and a third cavity disposed on opposite ends of the middle segment; and iii) a second set of protruding teeth and a third set protruding teeth disposed on opposite ends of the middle segment. Thus, a middle segment can have teeth on both ends, tooth-receiving cavities on both ends, or a set of teeth on one end and a cavity on the other. One or more segments can be joined to other middle segments, to male and to female segments.

The first set of teeth of the male segment are selectively engageable with the first cavity of the middle segment and the set of teeth of the middle segment are selectively engageable with the first cavity of the female segment. When the first and second sets of teeth, respectively, engage the first and second cavities, the middle segment is fixedly angled with respect to the end segment. By repeating this pivotably angled structure between a number of middle segments, the curvature of the track can be altered to the taste and specifications of the user. That the teeth of one segment engage the cavity of an adjacent segment means that the angle between two segments (and, by extension, the curvature of the overall track) is "locked" and only adjustable with the application of force; that is, the various segments of the inventive track do not flop around freely and loosely but rather retain their relative positions unless positioned differently by the user.

Further, gaps are preferably provided between the paths formed on the tops of the various segments. As the wheel or other part of the toy vehicle rides over these gaps, it produces a clacking sound which simulates the sound of a running train, for example.

DETAILED DESCRIPTION OF THE PREFERRED EMBODIMENT AND THE DRAWINGS

Description will now be given of the invention with reference to the attached FIGS. 1–8. It should be noted that these drawings are exemplary in nature and in no way serve to limit the scope of the invention, which is defined by the claims appearing herein below.

Figure 1:
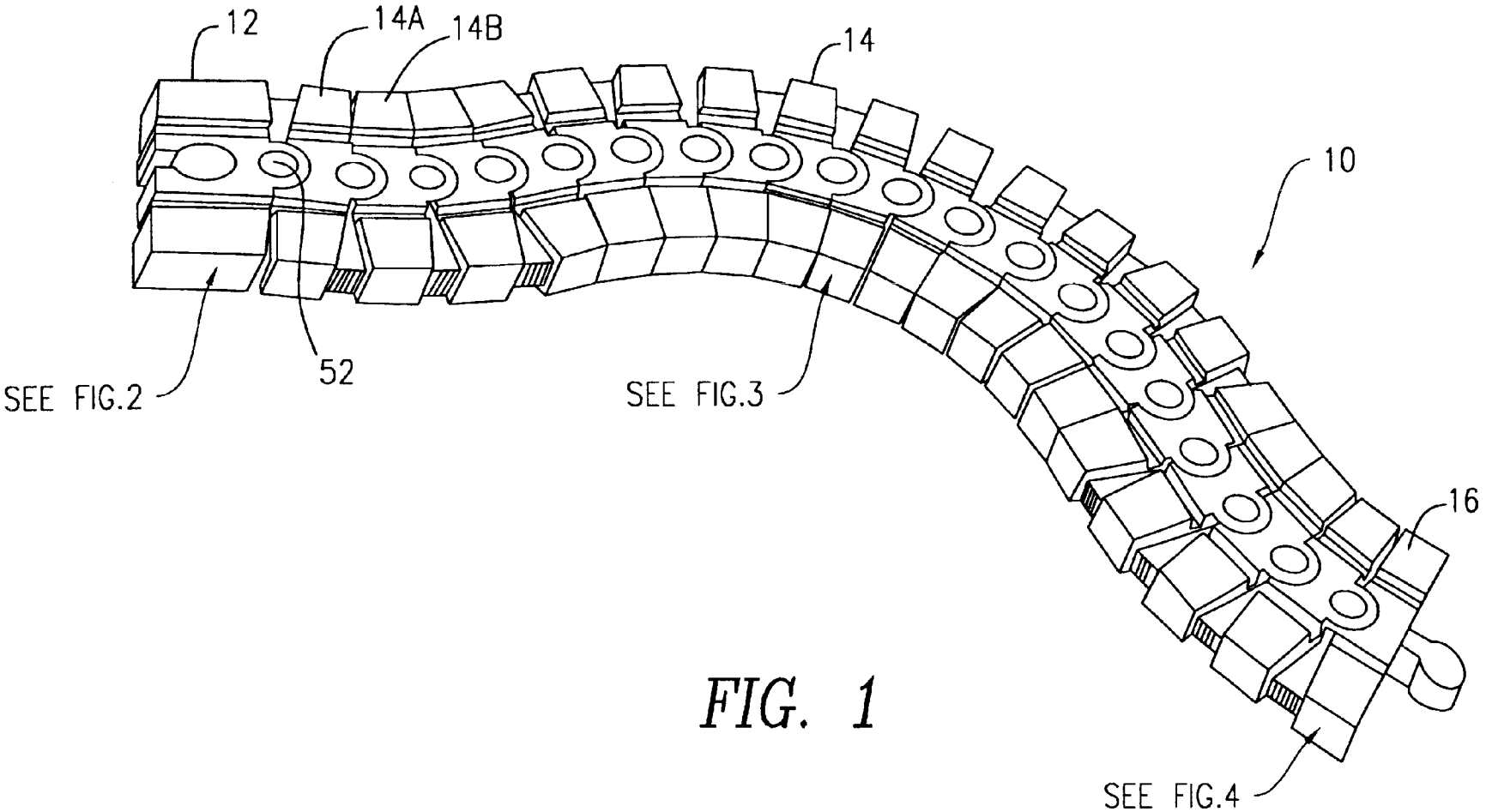
FIG. 1 is a perspective view of an embodiment of the present invention.

A flexible track for use with a toy train, for example, is designated generally by the reference numeral 10 in FIG. 1.

Figure 3:
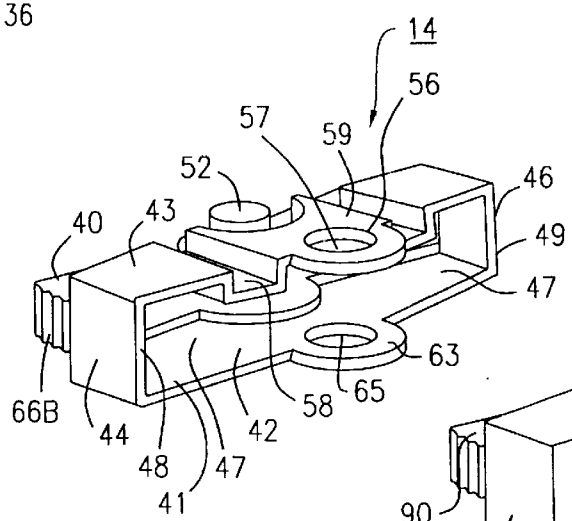
FIG. 3 is a rear perspective view of a middle track segment of a portion of the embodiment of FIG. 1.
Figure 4:
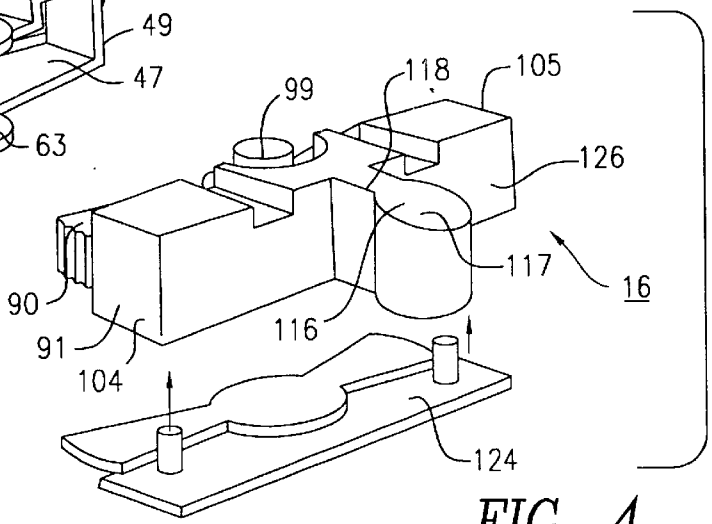
FIG. 4 is an exploded rear perspective view of a male track segment of the embodiment of FIG. 1.

The flexible toy train track 10 preferably comprises one female segment 12 (FIG. 2), one or more middle segments 14 (FIG. 3), and a male segment 16 (FIG. 4).

Figure 2:
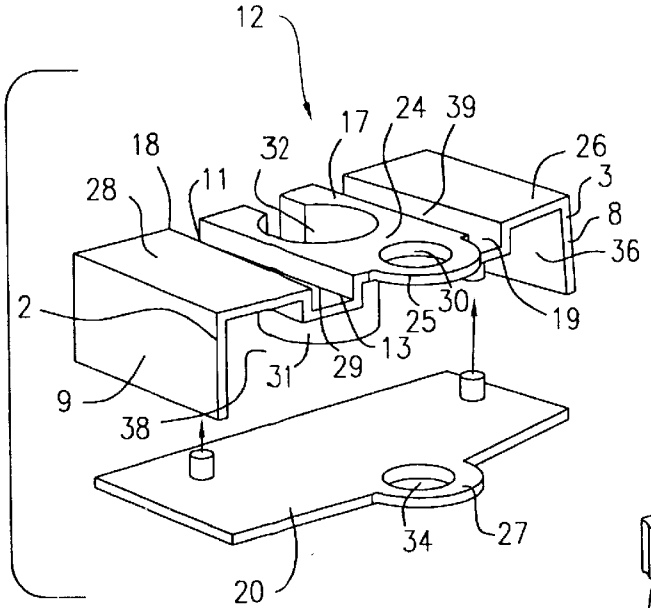
FIG. 2 an exploded rear perspective view of a female track segment of the embodiment of FIG. 1.

As shown in FIG. 2, the female segment 12 includes a top portion 18 and a base plate 20, which abut one another by a first side wall 9 and an opposed or second side wall 8. The first side wall 9 has a first or rear edge 2 and the second side wall 8 has a second or rear edge 3. The top portion 18 of the female segment 12 includes a center raised section 24, a raised first wing 26, and a second raised wing 28. The center section 24 has a forwardly projecting disc-like tab 25 on one end having a first aperture 30 and a keyhole slot 32 on the other end. A hub or walled portion 31 (see FIG. 6) of the center section 24 may extend between the top portion 18 and the base plate 20 and separate the space therebetween into first channel 36 and second channel 38 (see FIG. 2). The base plate 20 includes a second forwardly projecting tab 27 having a second aperture 34, preferably substantially aligned with tab 25 and aperture 30, respectively. Top portion 18 includes a first path or trackway 39 between center section 24 and first raised wing 26, having a forward end 17 and a rear end 19 and a second path or trackway 29 between center section 24 and second raised wing 28, having a forward end 11 and a rear end 13. The first path 39 and second path 29 are recessed beneath the surface of the top portion 18, each preferably continuous grooves in which the wheels of a toy train, for example, may be guided and travel.

Tabs 25 and 27 extend beyond the rear ends (3 and 19) of paths 29 and 39, respectively. Aperture 30 of disc-like tab 25 is suspended above aperture 34 of tab or disc 27. In this manner, apertures 30 and 34 form a means for receiving a pivot connection (a vertical cylinder) from a middle segment 14 (see FIG. 3, e.g.), and the first and second channels 36 and 38 form a socket-like means for receiving protruding portions of the middle segment 14. First edge 2 of a female segment 12 contacts a toothed section 66B (see FIG. 5) of a middle segment 14, and second edge 3 contacts a diametrically opposed toothed section 66A (see FIG. 5) of middle segment 14. In this manner, the female segment 12 may be locked into an angled position with respect to the first middle segment 14, as selected by the user of track 10.

Figure 5:
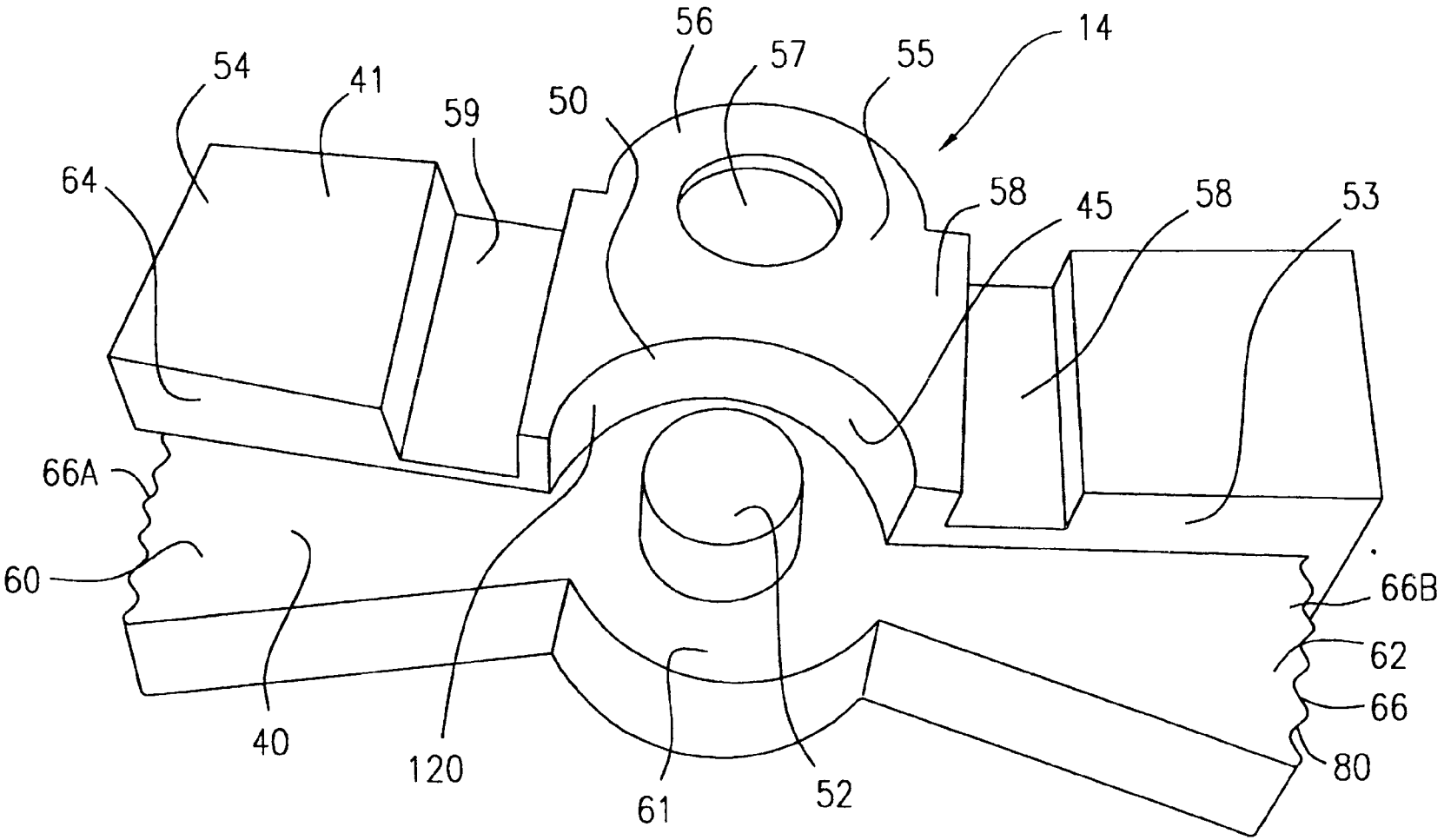
FIG. 5 is an upper front perspective view of the middle track segment shown in FIG. 3.
Figure 6:
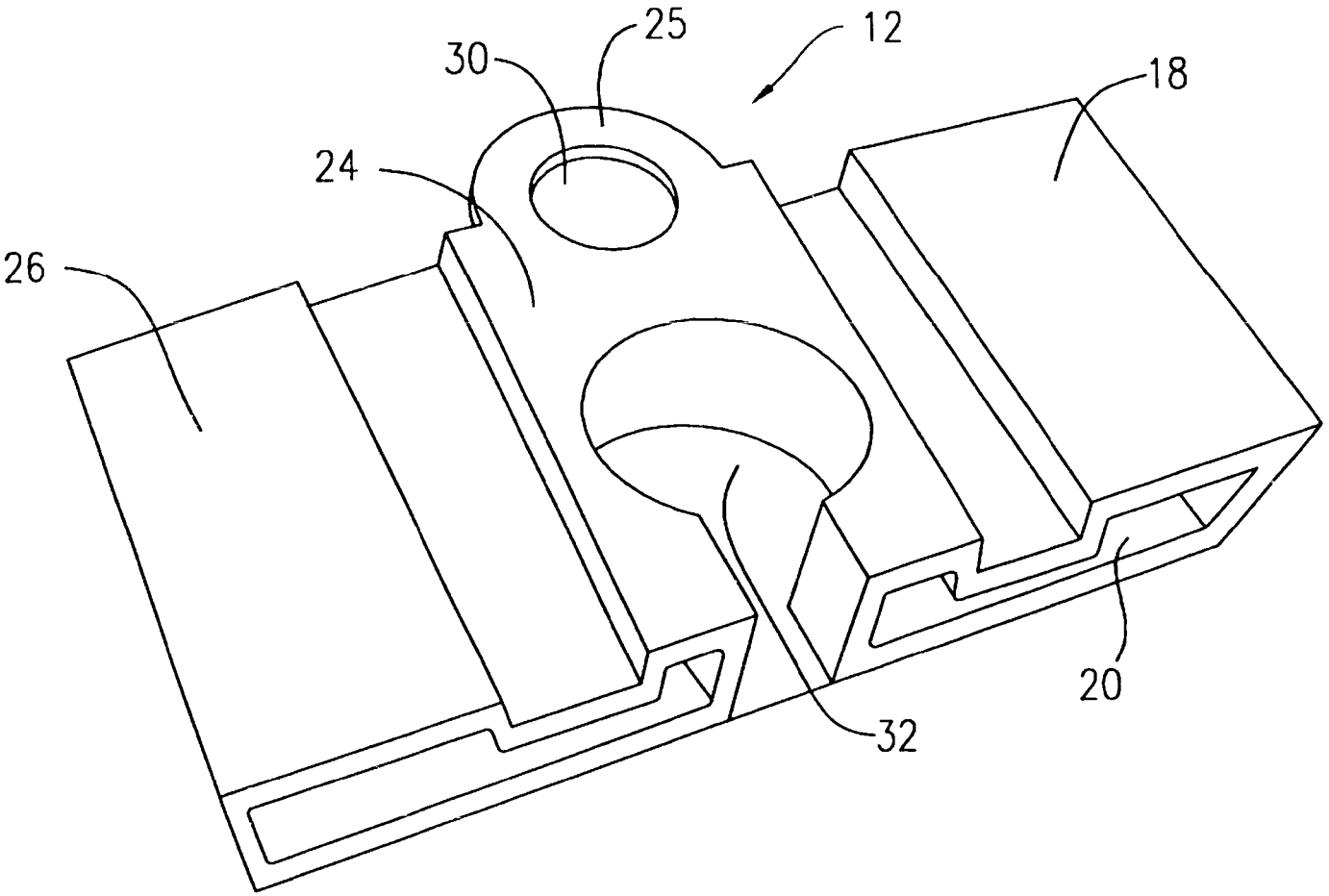
FIG. 6 is an upper front perspective view of the female track segment shown in FIG. 2.
Figure 7:
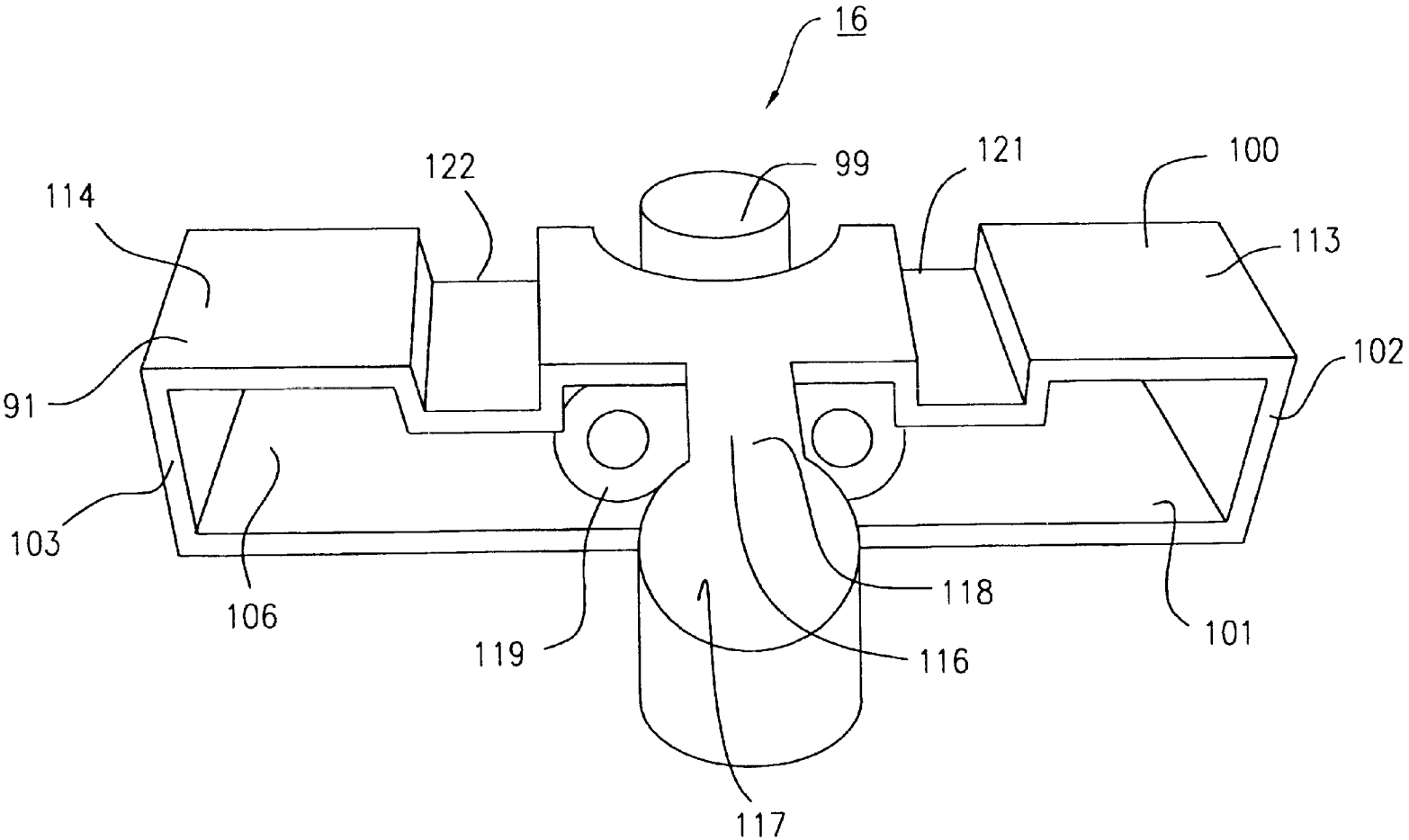
FIG. 7 is an upper rear perspective view of an embodiment of a male track segment of the present invention.

As shown in FIG. 3, a first middle segment 14 comprises an interior part 40 integral with an exterior part 41. As also shown in FIG. 5, the interior part 40 comprises wedge segments 60 and 62 having sets of teeth 66A and 66B, respectively. Wedge segments 60 and 62 are integral with a center cylindrical segment 61. The center cylindrical segment 61 is provided with a cylindrical and upwardly directed protrusion 52, the hinge for receipt between apertures 30 and 34. Cylindrical protrusion 52 has a smaller diameter than that of the center cylindrical segment 61. Exterior part 41 has a top 43 and a bottom 42 (see FIG. 3) joined by side walls 44 and 46. These define a cavity 47. Side wall 44 includes rear edge 48 and side wall 46 includes rear edge 49. As shown in FIG. 5, the exterior part 41 forms an inner circular wall segment 45. As shown in FIG. 3, bottom extends rearwardly to form a fourth disc-like tab or protrusion 63 having a fourth aperture 65 substantially aligned with third aperture 57 located above it.

The top 43 of exterior part 41 has side segments 53 and 54 (See FIG. 5) on opposite sides of raised middle section 55. The middle section 55 extends rearwardly to form a disc-like tab or projection 56 having a third aperture 57. On opposite sides of middle section 55, between the middle section 55 and the side segments 53 and 54 are formed path or trackway 59 and another path or trackway 58, which are respectively separated (yet aligned) from the first path or trackway 39 and the second path or trackway 29 of the female segment 12 (when connected thereto) by coupling interior part 40 and its forwardly extending wings into first and second channels 36 and 38. Interior part 40 and the trackways are sized with respect to the wheels of a train selected to run on the track so that the wheels of the train do not significantly fall onto or get trapped on the surface of interior part 40 or "derail." However, because there is a gap between the various sections -and thus the track paths are somewhat discontinuous (although aligned) - a vehicle such as a toy train passing along the track will make a constant clacking sound as the vehicle passes from one segment to the next. The clacking sound is an auditory feature which further simulates the running of a real train. As such, it is a desirable and entertaining feature.

As shown in FIG. 1, a first middle segment 14A may be connected to the female segment 12 by the protrusion 52 of the first middle section 14A mating with both the first aperture 30 of the female segment 12 and the second aperture 34 of the female segment 12 (protrusion 52 extends both above and below segment 61). When the first middle segment 14A is connected to female segment 12, wedge or wing segment 60 is notably slidable in and out of the first channel 36 of female segment 12 and the second wedge segment 62 is notably slidable in and out of the second channel 38 of the female segment 12 but in a direction rotationally opposite to that of the movement of wedge segment 60. In this manner, a user may select an angle between the first middle segment 14A and the female segment 12. Wedge segments 60 and 62 provide the appearance to the user of the track that the track is continuous, although it is in fact made of separate segments joined together.

As shown in FIG. 1, the first middle segment 14A may be connected to an identical second middle segment 14B by inserting the cylindrical protrusion 52 of the second middle segment 14B into apertures 57 and 65 of the first middle segment 14A. The second middle segment 14B has the same structure as the first middle segment 14A. Wedge segments 60 and 62 of the second middle segment 14B are notably slidable in and out of the cavity 47 of the first middle segment 14A. In this manner, the user may select an angle between the first middle segment 14A and the second middle segment 14B. A tooth 66 of the second middle segment 14B may be selected by the user of the track for locking the second middle segment 14B against third edge 48. Another tooth of the second middle segment 14B is thus diametrically aligned by the user of the track for locking a tooth of the second middle segment 14B against the fourth edge 49. Thus, the second middle segment 14B may be locked in a selected angular position of curvature with respect to the first middle segment 14A. In this manner, successive middle segments 14 may be placed in attachment to each other and temporarily locked in selected positions of curvature. A length of track can be built by adding middle segments.

Figure 8:
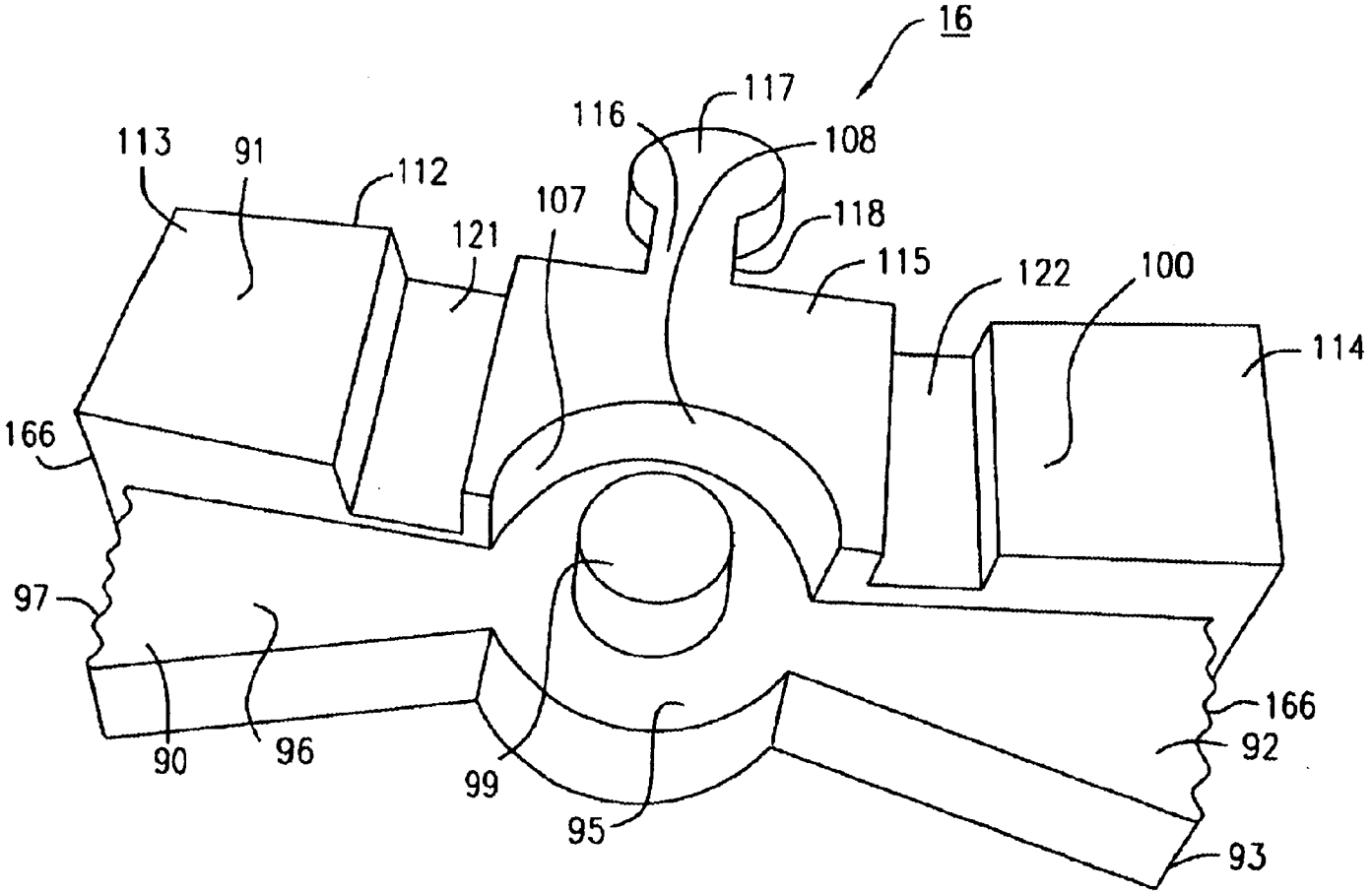
FIG. 8 is an upper front perspective view of the embodiment of the male track segment shown in FIGS. 4 and 7.

As shown in FIG. 4, male segment 16 may be formed by two components, a base plate 124 and an upper section 126. As shown in FIG. 8, the male segment 16 comprises a second interior section 90 integral with a second exterior section 91. As shown in FIG. 8, the second interior section 90 comprises opposed wedge segments 92 and 96, each having outwardly extending teeth 166, which are integrally formed with a center cylindrical segment 95.

The center cylindrical segment 95 is provided with an upwardly directed centrally located cylindrical protrusion 99. Cylindrical protrusion 99 has a smaller diameter than that of the center cylindrical supports segment 95. The second exterior section 91 has a contoured curved wall 108. The top 112 of the second exterior section 91 has raised side segments 113 and 114 on opposite sides of raised middle section 115. The cylindrical protrusion 99 of the male segment may hingedly attach to the third aperture 57 and fourth aperture 65 of the middle segment 14 to connect the male segment 16 to an adjacent middle segment 14. The teeth 166 of the male segment 16 may be locked in an angular position selected by the user against edges 48 and 49 of the middle segment 14. In this manner, the male segment 16 may be joined to an adjacent middle segment 14 in a similar manner to how the middle segments 14 are joined to each other.

A male segment 16 may be joined to a female-like segment 12 of a straight or another flexible track section to complete a stretch of track. The second exterior section 91 of the male segment 16 has a top 100 and a bottom 101 joined by a second vertical wall 104 and a third vertical wall 105 and forms a second cavity 106 (see FIG. 7). A tongue 116 protrudes from the middle section 115 and includes a round head 117. A support 119 may mechanically attach the tongue 116 and head 117 to the interior of the male segment 16. This support 119 maybe attached by screws through and into the second cavity 106 of the male segment 16. Side segments 113 and 114, with middle section 115 form two paths or trackways 121, 122, which are aligned with respect to the paths 58, 59 of the adjacent middle joint segment 14. However, the second interior segment 90 is sized with respect to the wheels of the train running along the track so that the wheels of the train do not derail, just as stated above. From the view of a user of the toy, the third outer end 93 and the fourth outer end 97 provide an appearance of continuity between the male segment 16 and the adjoining middle segment 14, although the angle of the male segment 16 may be changed with respect to its connection to the adjoining middle segment 14. Head 117 is sized to mate with the keyhole 32 of the female segment or to another piece of train track having a similarly sized keyhole.

In this manner, the female, middle, and male sections may be joined together to form a continuous flexible track length upon which a train may be driven. The flexible train track segment may be connected to other straight or specialty track segments. In use, a person may adjust each of the female, middle and male sections to the desired curvature by rotating a track section about a connecting pivot point and allowing a track segment to notably slide into an adjacent track segment. Thus, the person may adjust the angle of rotation, while visual continuity of the track segments is maintained and the train's wheels are maintained in the paths or trackways since they are greater in diameter than the distance between trackways of adjacent segments. The teeth of one segment cooperate with the rear edges or walls of the adjacent segment to maintain the track in the desired curved configuration. After use, the person may disengage the teeth from their locked position and dissemble the train track or merely force a rotation to change the overall curvature or shape. In this manner, the person may repeatedly select and create a track comprised of one or more curved segments having variable curvatures.

The invention is not limited to the above description. For example, it is described above that the middle segments are completely separate but attachable to both the male and female segments to form a track. However, it is also contemplated that the inventive track come pre-assembled in a variety of sections each having a plurality of segments already attached to one another (see, e.g., FIG. 1). Further, the drawings depict male and female segments having top and bottom portions which are secured or glued together. However, it is also contemplated that the male and female segments respectively be made as integral segments not requiring conjoining.

Also, the invention is described and shown with teeth sections disposed forwardly and corresponding receiving apertures disposed rearwardly on respective segments. However, it is understood that "forward" and "rearward" are relative terms simply meaning opposite ends of a given segment. What is important is that a wedge-shaped toothed section of one segment matingly engage within the cavity of an adjacent segment. For example, all middle segments need not be identical; some middle segments may be provided with wedge-shaped tooth sections on both ends interleaved or alternating with middle segments having mating cavities on both ends. A hinging post need not be located on the same end as a toothed section, and an aperture need not be located on the same end as a cavity; a post could also be located on the same end as a cavity, and an aperture could also be located on the same end as a toothed section.

Having described this invention with regard to specific embodiments, it is to be understood that the description is not meant as a limitation since further variations or modifications may be apparent or may suggest themselves to those skilled in the art. It is intended that the present application cover such variations and modifications, and the scope of the invention is defined by the claims appearing herein below.

What is claimed is:

1. A track for a toy vehicle, comprising:

at least one end segment comprising at least one of i) a male segment having a rearwardly projecting tongue and first forwardly projecting teeth; and ii) a female segment having a forward aperture to receive said tongue and a first rearward cavity; and at least one middle segment attachable to a front of said male segment and a rear of said female segment and pivotably attachable to at least one of said male and female segments, said middle segment having a second rearward cavity and second forwardly protruding teeth, wherein said first forwardly projecting teeth of said male segment are selectively engageable with side edges of said second rearward cavity of said middle segment and said second forwardly protruding teeth of said middle segment are selectively engageable with said first rearward cavity of said female segment.

2. A track for a toy vehicle according to claim 1, wherein said male, female, and middle segments each are provided with at least one trackway for receiving the wheels of the toy vehicle.

3. A track for the toy vehicle according to claim 2, wherein said end segment is provided with a gap in said trackway between said middle segment and at least one of said male or female segments to thereby cause the wheels of a toy vehicle traveling on said trackway to make a sound as it passes over said gap.

4. A track for a toy vehicle according to claim 3, further comprising a plurality of said middle segments attached between said male and female segments with a plurality of gaps formed between adjacent of said middle segments to thereby cause the wheels of the a vehicle traveling in said trackway to make a repetitive clacking sound as it passes over said plurality of gaps.

5. A track for a toy vehicle according to claim 1, said first and second forwardly projecting teeth being respectively disposed on first and second forwardly protruding wedges disposable at least partially within said first and second rearward cavities.

6. A track for a toy vehicle according to claim 1, further comprising:

a first post disposed forwardly on said male segment;

at least one first aperture formed rearwardly on said middle segment for receiving said first post, said first post being rotatable within said first aperture and said male segment being pivotable with respect to said middle segment.

7. A track for a toy vehicle according to claim 1, further comprising:

a second post disposed forwardly on said middle segment;

at least one second aperture formed rearwardly on said female segment for receiving said second post, said second post being rotatable within said second aperture and said middle segment being pivotable with respect to said female segment.

8. A track for a toy vehicle according to claim 7, further comprising:

a first post disposed forwardly on said male segment;

at least one first aperture formed rearwardly on said middle segment for receiving said first post, said first post being rotatable within said first aperture and said male segment being pivotable with respect to said middle segment.

9. A track for a toy vehicle according to claim 1, further comprising a plurality of said middle segments serially attached, wherein said track can form a segment of a toy train trackway.

10. A track for a toy vehicle according to claim 1, further comprising a plurality of pre-assembled track sections, each of said track sections having at least one of said end segments and at least one of said middle segments.

11. A track for a toy vehicle according to claim 1, further comprising both of said male and female segments attached at opposite ends of said track.

12. A track for a toy vehicle according to claim 11, further comprising a plurality of pre-assembled track sections, each of said track sections having one of said male segments, one of said female segments, and at least one of said middle segments disposed between said male and female segments.

13. A track for a toy vehicle according to claim 12, each of said track sections further comprising a plurality of said middle segments disposed between said male and female segments.

14. A track for a toy vehicle, comprising:

at least one end segment comprising at least one of i) a male segment having a tongue projecting from one of a first end and a second opposite end and a first set of teeth protruding from the other of said first and second ends; and ii) a female segment having an aperture adapted to receive a similarly-configured tongue of said male segment and a first cavity; and at least one middle segment pivotally attachable to said male segment and said female segment, said middle segment having any one of the following configurations: i) a second cavity and second set of teeth protruding and disposed on opposite ends of said middle segment; ii) a second cavity and a third cavity disposed on opposite ends of said middle segment; and iii) second set of teeth protruding and third set of teeth protruding and disposed on opposite ends of said middle segment, wherein said first set of teeth of said male segment are selectively engageable with said second cavity of said middle segment, if provided, and said second set of teeth, if provided, of said middle segment are selectively engageable with said first cavity of said female segment, and wherein when said first and second sets of teeth, if provided, respectively engage said first and second cavities, said middle segment is held at a predetermined angle with respect to said end segment.

15. A track for a toy vehicle according to claim 14, further comprising a plurality of said middle segments attached between two of said end segments.

16. A track for a toy vehicle according to claim 15, said plurality of said middle segments comprising:

a first set of middle segments each having said second cavity and said third cavity disposed on respective opposite ends of each of said first middle segments; and a second set of middle segments each having said second set of teeth and said third set of teeth disposed on respective opposite ends of each of said second middle segments, wherein said first and second sets of middle segments are alternating and interleaved in said track.

* * * * *